US010755562B2

(12) United States Patent
Martinez Openiano

(10) Patent No.: US 10,755,562 B2
(45) Date of Patent: Aug. 25, 2020

(54) TRAFFIC SIGN AND SYSTEM FOR INCREASING AWARENESS OF THE SAME

(71) Applicant: Renato Martinez Openiano, Chula Vista, CA (US)

(72) Inventor: Renato Martinez Openiano, Chula Vista, CA (US)

( * ) Notice: Subject to any disclaimer, the term of this patent is extended or adjusted under 35 U.S.C. 154(b) by 0 days.

(21) Appl. No.: 16/178,622

(22) Filed: Nov. 2, 2018

(65) Prior Publication Data

US 2020/0111352 A1 Apr. 9, 2020

Related U.S. Application Data

(60) Provisional application No. 62/707,991, filed on Nov. 27, 2017, provisional application No. 62/708,528, filed on Dec. 11, 2017, provisional application No. 62/761,482, filed on Mar. 24, 2018.

(51) Int. Cl.
*G08G 1/07* (2006.01)
*G08G 1/095* (2006.01)

(52) U.S. Cl.
CPC ..... *G08G 1/07* (2013.01); *G08G 1/095* (2013.01)

(58) Field of Classification Search
CPC . G08G 1/0965; G08G 1/096791; G08G 1/095
See application file for complete search history.

(56) References Cited

U.S. PATENT DOCUMENTS 5,635,920 A * 6/1997 Pogue ..... G08G 1/096716 340/901
6,157,321 A * 12/2000 Ricci ..... G01S 13/931 235/384
2007/0242337 A1* 10/2007 Bradley ..... B60Q 1/0017 359/237
2015/0109148 A1* 4/2015 Cheatham, III ..... G08G 1/005 340/944

* cited by examiner

*Primary Examiner* — Omeed Alizada
(74) *Attorney, Agent, or Firm* — Michael D. Eisenberg

(57) ABSTRACT

A system for increasing awareness of a traffic sign is provided. The traffic sign has a visual sign having an image representing a traffic instruction. The system includes a signal transmitter and at least one receiving device. The signal transmitter is associated with the visual sign and is configured for transmitting an encoded electromagnetic wave with encoding indicative of the traffic instruction. The receiving device is associated with a user or a vehicle of the user and is configured to detect the electromagnetic wave when the signal receiver is in line of sight of and within a predetermined distance from the visual sign, decode the detected electromagnetic wave to extract information indicative of the traffic instruction, and emit an output indicative of the traffic instruction.

20 Claims, 16 Drawing Sheets

TRAFFIC SIGN AND SYSTEM FOR INCREASING AWARENESS OF THE SAME

CROSS-REFERENCES TO RELATED APPLICATIONS

The present application claims priority from U.S. Provisional Application Ser. No. 62/707,991 filed on Nov. 27, 2017, U.S. Provisional Application Ser. No. 62/708,528 filed on Dec. 11, 2017, and U.S. Provisional Application Ser. No. 62/761,482 filed on Mar. 24, 2018, which are hereby incorporated herein by reference in their entirety.

TECHNICAL FIELD

The present application, in some embodiments thereof, relates to the field of traffic signs. More specifically, it relates to a system for increasing awareness of the traffic signs.

BACKGROUND

Traffic signs are essential to safe driving. Traffic signs visually represent instructions to drivers and pedestrians. Some instructions may include orders, such as a speed limit, or an instruction to stop. Other instructions may include a warning of dangers ahead, such as dangerous curves, construction work, etc.

Traffic signs may be permanent or changing. A stop sign at a crossroads is a permanent sign. A traffic light, on the other hand, is a changing sign, which displays different instructions at different times: red light instructing drivers to stop, yellow light instructing drivers to yield, green light instructing drivers to go, green arrow lights instructing drivers to go in directions shown by the arrow.

It is of paramount importance for drivers to pay attention to traffic signs, for their own safety and for the safety of other drivers and pedestrians around them. Drivers, however, may be sometimes distracted and may not pay attention to traffic signs.

Self-driving vehicles include sensor systems and algorithms to enable onboard computers to drive cars. Among their many systems, self-driving vehicles include visual sensors (e.g., cameras) and complex image processing algorithms to identify traffic signs, in order to control the car's behavior according to the instructions of the traffic signs.

BRIEF SUMMARY OF THE INVENTION

There is therefore a need for a system to increase awareness of traffic signs, both for human drivers and for self-driving vehicles. The present invention addresses this problem.

Therefore, an aspect of some embodiments of the present invention relates to a traffic light comprising at least one light emitting device, a signal transmitter, and a control unit. The at least one light emitting device is configured for emitting light of a first color and/or first shape. The signal transmitter is associated with the light emitter and is configured for transmitting an encoded electromagnetic wave with encoding indicative of the first color and/or first shape of the light emitted by the light emitting device associated with the signal transmitter, such that the encoded electromagnetic wave is receivable by a detector in line of sight of and within a predetermined distance from the traffic light. The control unit is configured for activating the light emitting device together with the associated signal transmitter and deactivating the light emitting device together with the associated signal transmitter.

In a variant, the traffic light includes a plurality of light emitting devices and a plurality of signal transmitters. Each light emitting device is configured for emitting light of a respective color and/or shape. Each signal transmitter is associated with a respective one of the light emitting devices and is configured for emitting a respective electromagnetic wave with encoding indicative of the respective color and/or shape of the respective light emitting device. The control unit is configured for selectively activating each of the signal transmitters together with the respective light emitting device.

In another variant, the traffic light includes a plurality of light emitting devices, a plurality of signal transmitters, and a plurality of control units. Each light emitting device is configured for emitting light of a respective color and/or shape. Each signal transmitter is associated with a respective one of the light emitting devices and is configured for emitting a respective electromagnetic wave with encoding indicative of the respective color and/or shape of respective light emitting device. Each control unit is associated with a respective one of the light emitting devices and is configured for selectively activating the signal transmitter associated with the respective light emitting device together with the respective light emitting device.

In yet another variant, the traffic light includes a plurality of light emitting devices, each configured for emitting light of a respective color and/or shape. The signal transmitter is configured for transmitting a plurality of electromagnetic waves, each electromagnetic wave having a respective encoding indicative of a respective color and/or shape emitted by a respective light emitting device. The control unit is configured for selectively activating each of the light emitting devices and for controlling an operation of the signal transmitter, such that the electromagnetic wave transmitted by the transmitter has the encoding indicative of the color and/or shape of the active light emitting device.

In a further variant, the light emitting device comprises a plurality of light sources arranged in an array.

Optionally, the light sources comprise light emitting diodes (LEDs).

Optionally, the signal transmitter is located within the array of the light sources.

In a variant, the traffic light includes one or more signal transmitters located within the array and configured for simultaneously transmitting the encoded electromagnetic wave.

In another variant, the traffic light includes a cover which includes a diffusing section and a transparent section. The diffusing section is located downstream of the light sources and is configured to diffuse the light emitted by the light source. The transparent section is substantially transparent to the electromagnetic wave, is located downstream of the signal transmitter, and is configured to enable decreased diffraction of the encoded electromagnetic signal.

In a variant, the transmitter comprises an elongated guidepost, configured to position the transmitter closer to the cover with respect to the light sources.

In another variant, the transparent section comprises material that is thinner than diffusing section.

In yet another variant, the transparent section comprises an opening on the cover.

According to some embodiments of the present invention, the signal transmitter comprises at least one of an infra-red (IR) light source, a visible light source, a laser light source, and a radio wave source.

In a variant, the IR light source comprises an IR light emitting diode (IRLED), while the visible light source comprises a light emitting diode (LED).

Another aspect of some embodiments of the present invention relates to a traffic sign. The traffic sign includes a visual sign and a signal transmitter. The visual sign has an image representing a desired traffic instruction. The signal transmitter associated is with the visual sign and is configured for transmitting an encoded electromagnetic wave with encoding indicative of the traffic instruction, such that the encoded electromagnetic wave is receivable by a detector in line of sight of and within a predetermined distance from the visual sign.

Yet another aspect of some embodiments of the present invention relates to a system for increasing awareness of a traffic sign having a visual sign having an image, the image representing a desired traffic instruction. The system includes a signal transmitter and at least one receiving device. The signal transmitter is associated with the visual sign and is configured for transmitting an encoded electromagnetic wave with encoding indicative of the traffic instruction. The at least one receiving device is associated with a user or a vehicle of the user and includes a detector, a decoder, and an output unit. The detector is configured to detect the electromagnetic wave when the signal receiver is in line of sight of and within a predetermined distance from the visual sign. The decoder is configured to decode the electromagnetic wave detected by the detector to extract information indicative of the traffic instruction. The output unit is configured to emit an output indicative of the traffic instruction.

In a variant, the visual sign comprises at least one light emitting device, configured for emitting light of a desired color and/or in a desired shape to represent the desired instruction. The system comprises a control unit associated with the visual sign, the control unit being configured to activate the light emitting device together with the associated signal transmitter, according to a desired timing.

In another variant, the output unit is configured to emit one or more of an electronic signal, a visible output, an audio output, and a haptic output.

In yet another variant, the user is a pedestrian, the receiving device is configured to be worn by the user, such that the detector faces a direction faced by the pedestrian wearing the receiving device, and the detector is configured for detecting the electromagnetic wave only when a propagation axis of the electromagnetic wave is within a range of orientations around a orientation faced by the detector.

A further aspect of some embodiments of the present invention relate to a receiving device associated with a user or a vehicle of the user. The receiving device includes a detector, a decoder, and an output unit. The detector is configured to detect an electromagnetic wave emitted by a signal transmitter associated with a traffic sign, the electromagnetic wave having encoding indicative of a traffic instruction represented by the traffic sign. The detector is configured to detect the electromagnetic wave when the receiving device is in line of sight of and within a predetermined distance from the traffic sign. The decoder is configured to decode the electromagnetic wave detected by the detector to extract information indicative of the traffic instruction. The output unit is configured to emit an output indicative of the traffic instruction.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
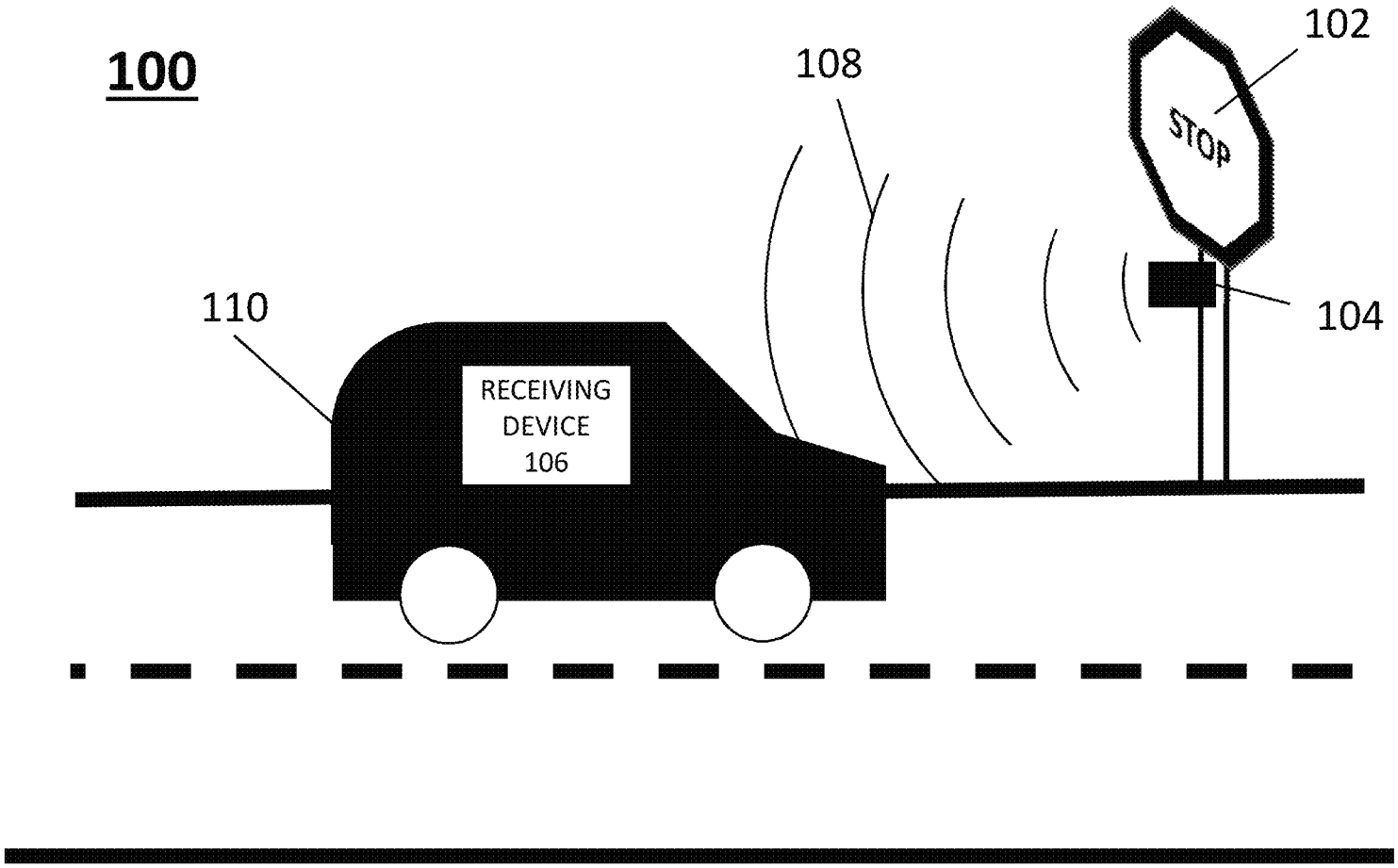
FIG. 1 illustrates a system for increasing awareness of a traffic sign, according to some embodiments of the present invention.

FIG. 1 illustrates a system 100 for increasing awareness of a traffic sign 102, according to some embodiments of the present invention.

The sign 102 has a visual sign configured for being seen by a driver (or identified by a sensor and a processing unit of a self-driving vehicle), in order to convey an instruction to the driver (or to the self-driving vehicle). The system 100 includes a signal transmitter 104 and a receiving device 106.

The signal transmitter 104 is associated with the traffic sign 102 and is configured for transmitting an electromagnetic wave 108 having an encoding indicative of the instruction of the traffic sign 102. The signal transmitter is configured to transmit the electromagnetic wave so that the receiving device 106 receives the electromagnetic wave only when the receiving device 106 has a line of sight with the visual sign and is within a certain distance of the visual sign. Therefore, the signal transmitter is configured for emitting/transmitting a directional electromagnetic wave. As will be discussed further below, one or more signal transmitters 104 can be used together in order to generate the desired electromagnetic wave.

One way generating a directional electromagnetic wave is by using one or more visible light LEDs and/or one or more infrared LEDs (IRLEDs) as part of the signal transmitter 104. It is well-known in the field that LED emissions are directional, as electromagnetic waves (IR or visible light) are produced by only the outside surface of the LED semiconductor die placed on top of a reflective cavity. The transparent epoxy lens in front of the LED magnifies the light produced. Only the outside surface of the LED semiconductor die emits the electromagnetic waves which then passes through the transparent epoxy lens, thereby producing directional light.

Optionally, the receiving device is designed to receive only electromagnetic waves propagating along an axis that is within a range of orientation around the orientation faced by a detector of the receiving device. In this manner, if the user and detector face a certain traffic sign (and associated signal transmitter) while other traffic signs with their respective signal transmitters are close by but do not face the detector, then the detector will detect the electromagnetic waves emitted by the signal transmitter facing the detector.

The receiving device 106 is associated with a vehicle 110 and is configured to receive the electromagnetic wave 108, to decode the electromagnetic wave 108 in order to extract information indicative of the traffic instruction, and to emit an output indicative of the instruction. The sensitivity of the receiving device is 106 is set such that the receiving device detects the electromagnetic wave 108 only when the receiving device 108 has line of sight with the traffic sign 102 and is within a desired distance from the traffic sign 102.

The electromagnetic wave 108 may be any kind of electromagnetic wave, such as a radio wave, an infrared light, laser light, or visible light.

The receiving device 106 may be associated with a user (who may be a pedestrian or a driver) or with a vehicle (e.g., a user-driven vehicle or a self-driving vehicle). If the receiving device 106 is associated with a user or a user-driven vehicle, the output emitted by the receiving device 106 may be a visible output (e.g. flashing light, an image on a display, or writing in a display), and/or an audio output (e.g., an alarm, a human voice), and/or a haptic output (e.g., a vibration of the car seat, a vibration of an output unit touching the user). If the receiving device 106 is associated with a self-driving vehicle, the receiving device 106 is configured for emitting an output in the form of an electronic signal indicative of data that may be received and processed by the computer controlling the self-driving vehicle.

Though many ways of encoding the electromagnetic wave are available, one example of producing the electromagnetic wave would be via an infrared source (e.g., an infrared LED (IRLED)), while encoding the electromagnetic wave may include using the NEC or RC5 protocols, which are used in infrared remote controls for ordinary home appliances such as televisions, home stereos, cable boxes.

Depending on the chosen protocol (either NEC or RC5 protocol), the codes for a stop sign would for example produce an encoded signal to the IRLED designated to represent red stop light having the combination of letters "S", "T", "O", "P" in exact sequence. The codes would continuously repeat in exact sequence. The receiving device is programmed to decode the received combination of: "S", "T", "O", "P" in exact sequence to designate that the traffic sign is a stop sign For programming purposes, it would be much easier to designate these group of words rather that numbers, as these group of letters in itself already indicate their particular designations, whereas for numbers will be harder, and also help during troubleshooting.

The encoding using these codes makes this system less prone to outside light interference, particularly because the receiving device would not entertain any outside light source which did not match the exact sequence of pulsed codes it in its memory. In addition, as redundancy, the receiver could even be programmed to be activated if there were three or more complete sets of the designated group of words received in sequence, which improves even further its capacity to eliminate outside interference.

As will be discussed further below, the traffic sign may include traffic lights, where each light color corresponds to a respective encoding. For example, the code for a "RED" stop light for example would produce an encoded signal to the IRLED designated to represent red stop light having the combination of letters "R", "E", "D" and "S", "T", "O", "P" in exact sequence and the codes would continuously repeat in the exact sequence as long as the red traffic light is activated. The code is be stored in a memory unit associated with the signal transmitter, and every time the red light is active, an encoder associated with the signal transmitter is activated to produce the pulsed encoded signal to the IRLED corresponding to the designated traffic light color of Red. The receiving device is programmed to decode the received combination of: "R", "E", "D", "S", "T", "O", "P" in exact sequence to designate that red stop light is turned on.

For "Green" stop light would use the the combination of letters: "G", "1", "R", "E", "N", "G", "O"; the "1" after the "G" on Green, helps better differentiate the "G" in Green as contrasted to the "G" in Go.

For Amber (yellow), would use the combination of letters: "A", "M", "B", "E", "R", "S", "L", "O", "W".

For "Go Cross" instructing pedestrian to cross: "G", "O", "C, "R", "O", "S". Note that the there is only one letter "S" used, which is no problem as the encoder will have in the memory what the specific codes to produce and the decoder will know what combination of specific letters will designate a particular traffic signal.

Figure 2:
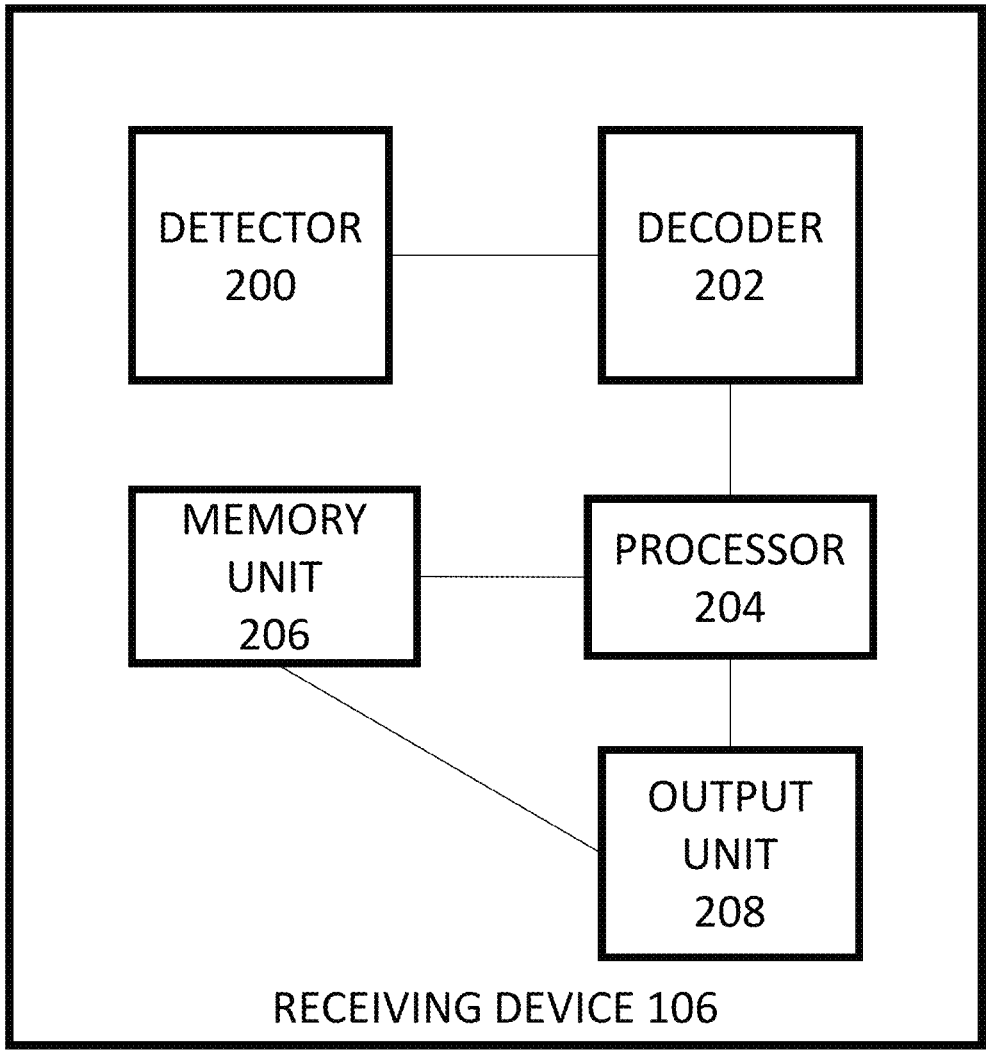
FIG. 2 illustrates an example of a receiving device of the system of FIG. 1, according to some embodiments of the present invention.

FIG. 2 illustrates an example of the receiving device 106 of the system 100 of FIG. 1, according to some embodiments of the present invention.

The receiving device 106 includes a detector 200, a decoder 202, a first processor 206, a first memory unit 204, and an output unit 208.

The detector 200 is configured to detect the electromagnetic wave. The detector may include a visible light detector, a radio-wave detector (antenna), an infrared (IR) light detector, or a laser light detector, and is tuned to receive electromagnetic waves above a certain power in the band emitted by the signal transmitter 102 of FIG. 1.

The decoder 202 is configured for decoding the received electromagnetic waves to extract information relating to the instruction of the traffic sign. The processor 204 is configured for receiving the information extracted by the decoder 202 and for processing the information. The processing may include comparing the information to predetermined data pieces (indicative of different traffic instructions) stored in the memory unit 206. When the extracted information matches a piece of data, the processor is configured for instructing the output unit 208 to emit an output indicative of the traffic instruction corresponding to the matched data piece. In some embodiments of the present invention, data relating to the output to be emitted is stored in the first memory unit 206 and is accessed by the output unit 208 for emitting the output.

Figure 3:
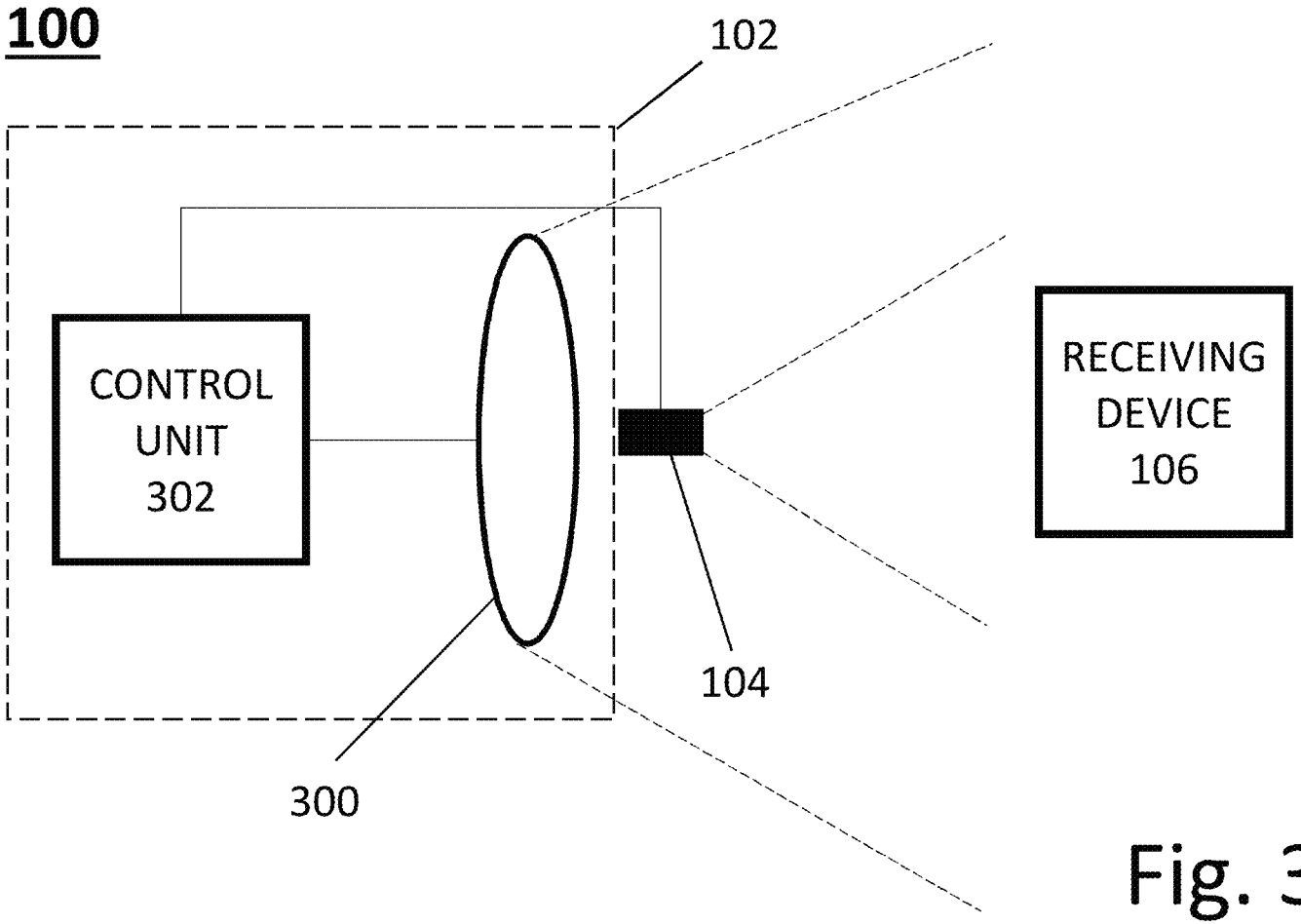
FIG. 3 illustrates a system for increasing awareness of a traffic light, according to some embodiments of the present invention.

FIG. 3 illustrates a system 100 for increasing awareness of a traffic light, according to some embodiments of the present invention.

As mentioned above, the traffic sign may be a permanent traffic sign (e.g., a stop sign) or a changing traffic sign (e.g., a traffic light). In FIG. 3, the traffic sign 102 includes a traffic light. The traffic light includes at least one light emitting device 300 and a control unit 302.

The light emitting device 300 is configured for emitting light of a desired color and/or shape, the color and/or shape being indicative of an instruction. The control unit 302 is configured for activating the light emitting device according to a desired timing or a desired instruction. The control unit 302 is also in communication with the signal transmitter 104, and is configured for activating the signal transmitter 104 together with the light emitter 300 for deactivating the signal transmitter 104 together with the light emitter 300. In this manner, the signal transmitter 104 is configured for emitting the electromagnetic signal only when the light emitting device 300 associated with it is on.

As mentioned above, the signal transmitter 104 and the receiving device 106 are designed so that the receiving device 106 is configured for detecting the electromagnetic signal emitted by the receiving device 104 only when the receiving device 106 has a line of sight with the light emitting device 300.

Figure 4:
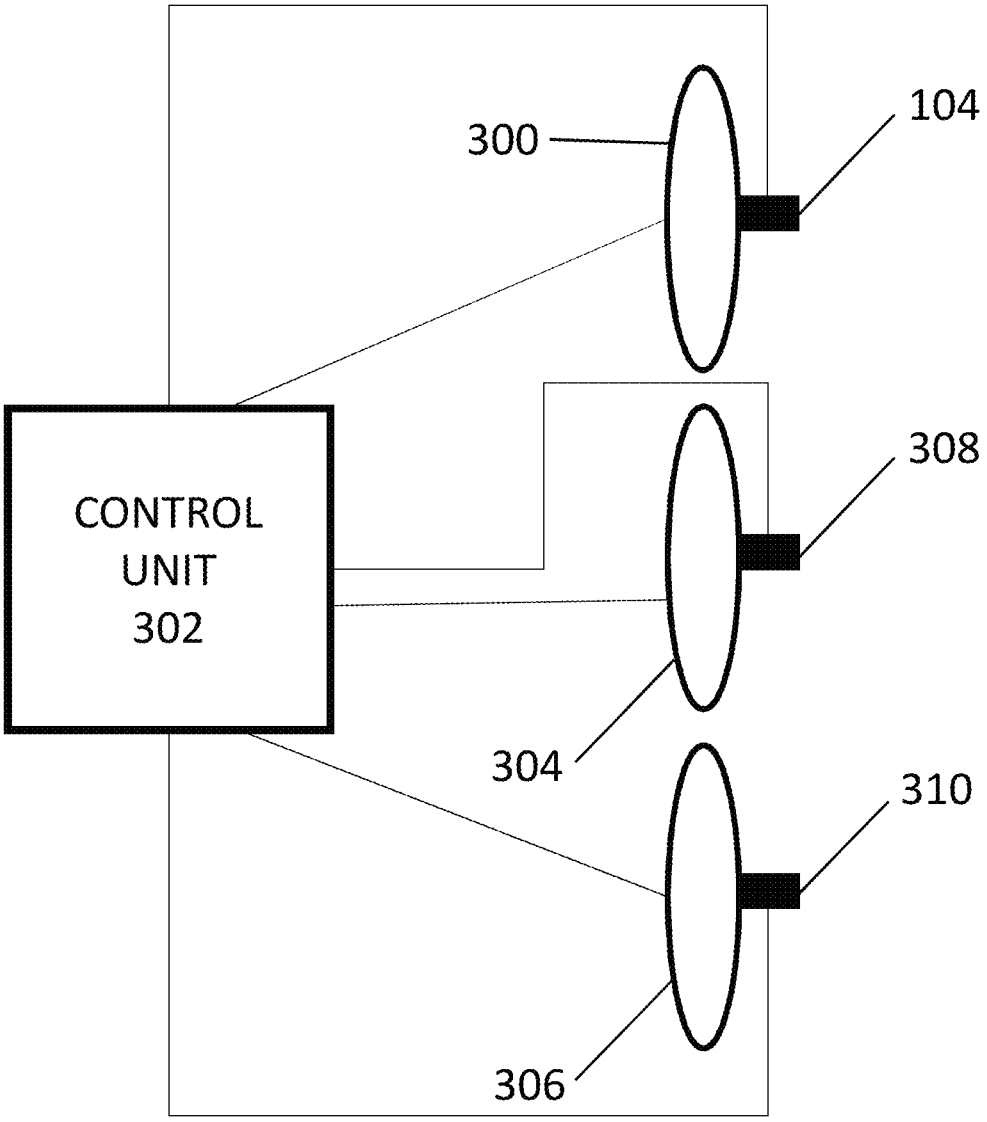
FIG. 4 illustrates a traffic light of the present invention, having a plurality of signal emitters controlled by a single control unit.

FIG. 4 illustrates a traffic light of the present invention, having a plurality of signal transmitters controlled by a single control unit.

In some embodiments of the present invention, the traffic light has a plurality of light emitting devices 300, 304 and 306, each emitting a respective color and/or shape, and each representing a respective instruction. For example, the first light emitting device 300 may be configured for emitting a red light representing the instruction to stop, the second light emitting device 304 may be configured for emitting an amber (yellow) light representing the instruction to slow/yield, and the third light emitting device 306 may be configured for emitting a green light representing the instruction to go. The control unit 302 is configured for selectively activating (turning on) the different light emitting device.

Each light emitting device is associated with a respective signal transmitter. In the example of FIG. 4, the first light emitting device 300 is associated with a first signal transmitter 104, the second light emitting device 304 is associated with a second signal transmitter 308, and the third light emitting device 306 is associated with a third signal transmitter 310. Each signal transmitter is configured for emitting an electromagnetic wave having a respective encoding indicative of the color and/or shape of the light emitted by the light emitting device with which the signal transmitter is associated.

The control unit 302 activates each signal transmitter together with the associated light emitting device. In this manner, each signal transmitter emits the respective electromagnetic wave with encoding indicative of the color and/or shape of the respective light emitting device only when the respective light emitting device is activated (on).

Figure 5:
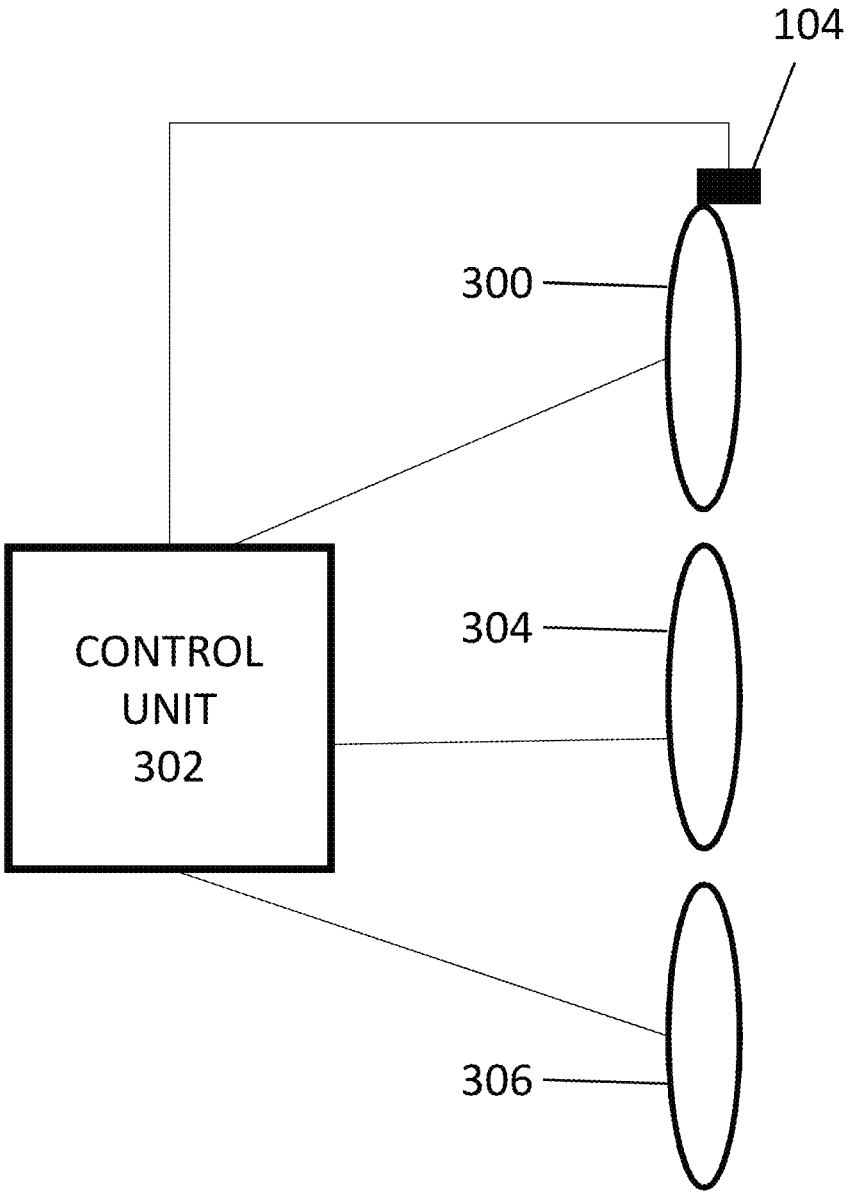
FIG. 5 illustrates a traffic light of the present invention, having a single signal emitter configured for encoding an electromagnetic wave in different manners.

FIG. 5 illustrates a traffic light of the present invention, having a single signal transmitter 104 configured for encoding an electromagnetic wave in different manners.

As explained above, in some embodiments of the present invention, the traffic light has a plurality of light emitting devices 300, 304 and 306, each emitting a respective color and/or shape, and each representing a respective instruction. The control unit 302 is configured for selectively activating (turning on) the different light emitting device.

The signal transmitter 104 is configured for selectively emitting differently encoded electromagnetic waves in response to a control signal from the control unit 302. When the control unit 302 activates a light emitting device, the control device 302 also sends the signal transmitter 104 a control signal indicative of the light emitting device being activated. In response to the control signal, the signal transmitter 104 emits the electromagnetic signal with encoding indicative of the color and/or shape of the active light.

Figure 6:
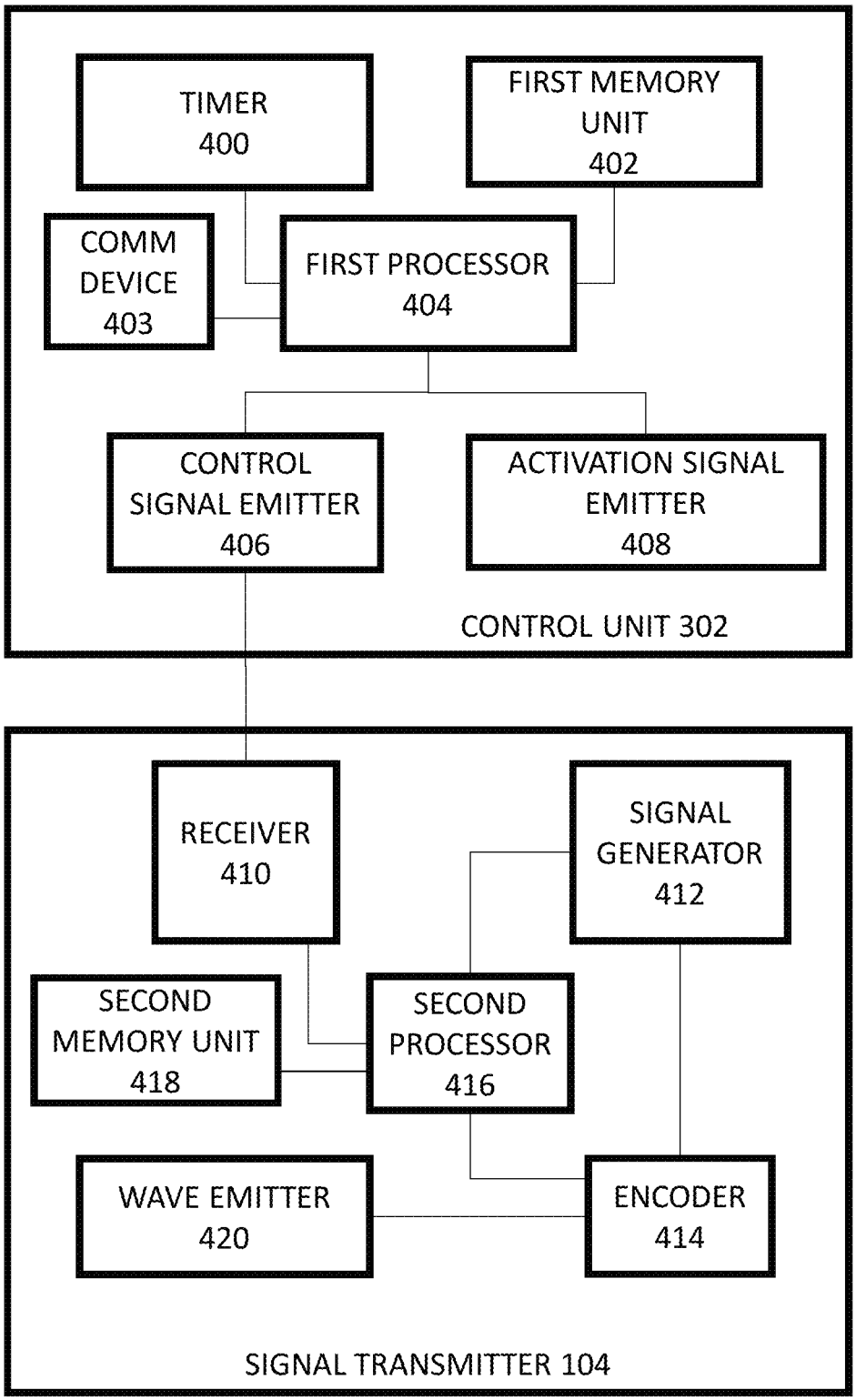
FIG. 6 illustrates details of the control unit and signal transmitter of FIG. 5.

FIG. 6 illustrates details of the control unit and signal transmitter of FIG. 5.

The control unit 302 includes a timer 400, a first memory unit 402, a first processor 404, a control signal emitter 406, an activation signal emitter 408, and optionally a communication device 403. The signal transmitter 104 includes a receiver 410, a signal generator 412, an encoder 414, a second processor 416, a second memory unit 418, and a wave emitter 420.

In the control unit, the first processor 404 is connected to a timer 400, the first memory unit 402, and optionally to the communication device 403. The first memory unit 402 stores instructions for operating the control signal emitter 406 and the activation signal emitter 408, according to time kept by the timer 400 and optionally to instructions from the communication device 403. Generally, different light emitting devices are activated selectively according to the timer and control signals are generated according to the activated light emitting devices. Optionally, an external user may directly take control of the traffic lights via the communication device 403 to change the instructions in the first memory unit or to instruct the traffic lights to work in a desired manner (e.g., flashing yellow light).

The first processor 404 receives the instructions from the first memory unit 402 and the time counted by the timer 400 (and optionally instructions from the communication device 403) and instructs the activation signal emitter 408 to selectively activate the desired light emitting device. Simultaneously, the first processor 404 instructs the control signal emitter 406 to generate a control signal to be received by the signal transmitter 104, to direct the signal transmitter to emit an electromagnetic wave having an encoding indicative of the active light emitting device.

In the signal transmitter, the receiver 410 is in wired or wireless communication with the control unit's control signal emitter 406 and is configured for receiving the control signal. The control signal is sent to the second processor 416, which instructs the signal generator to generate a first signal configured for activating the wave emitter 420. The first signal is received by the encoder 414, which adds encoding to the first signal, in order to cause the wave emitter 420 to emit the electromagnetic wave with a desired encoding. The encoder's operation is controlled by the second processor 416. The second memory unit 418 stored instruction regarding the different kinds of encoding to be applied to the first signal in response to different control signals. The second processor receives the control signal and accesses the second memory unit 418 to instruct the encoder 414 to apply a desired encoding indicative of the color and/or shape of the active light emitting device.

Figure 7:
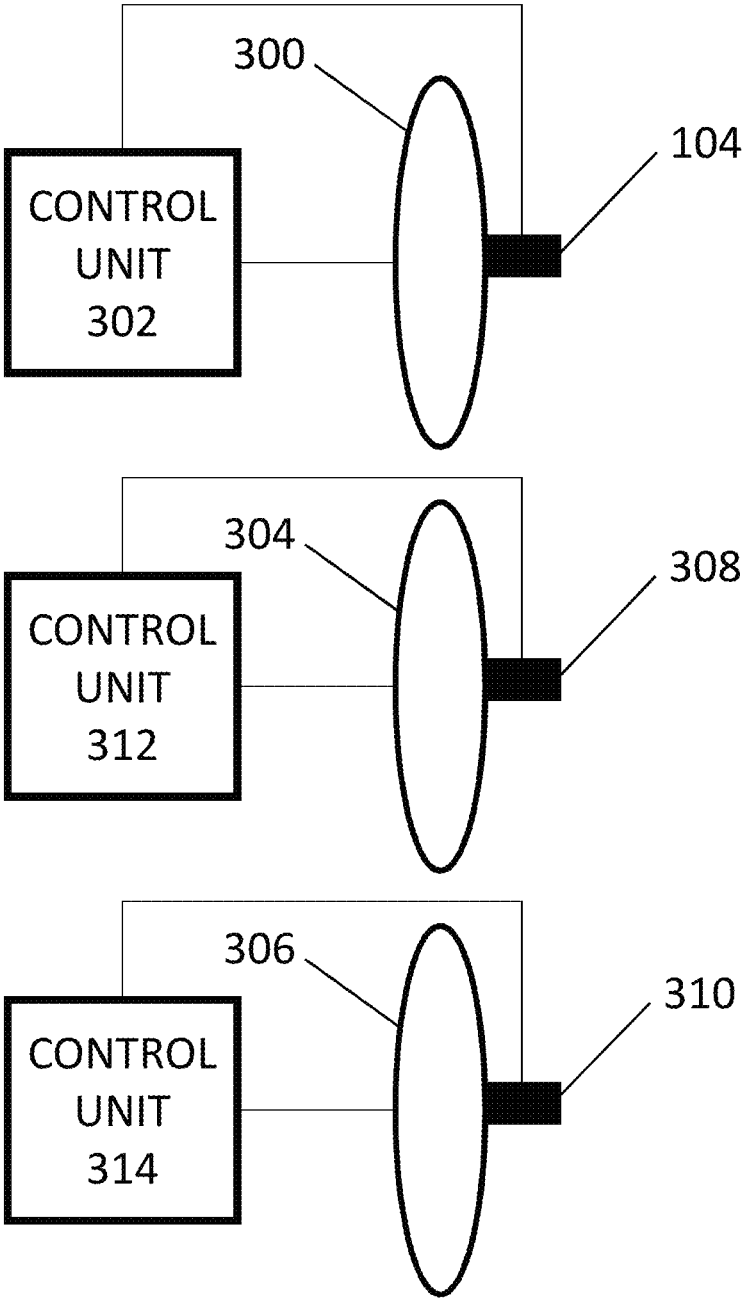
FIG. 7 illustrates a traffic light of the present invention, having a plurality of control units, each controlling the operation of a respective light emitting device and a corresponding signal transmitter.

FIG. 7 illustrates a traffic light of the present invention, having a plurality of control units, each controlling the operation of a respective light emitting device and a corresponding signal transmitter.

In the example of FIG. 7, the traffic light includes a plurality of light emitting devices (300, 304, 306), a plurality of control units (302, 312, 314), and a plurality of signal transmitters (104, 308, 310). Each light emitting device is associated with a respective control unit and a respective signal transmitter. Each control unit is configured for selectively activating and deactivating the respective light emitting device together with the respective signal transmitter. Each signal transmitter is configured for emitting an electromagnetic wave with respective encoding indicative of the color and/or shape of the respective light emitting device.

Figure 8A:
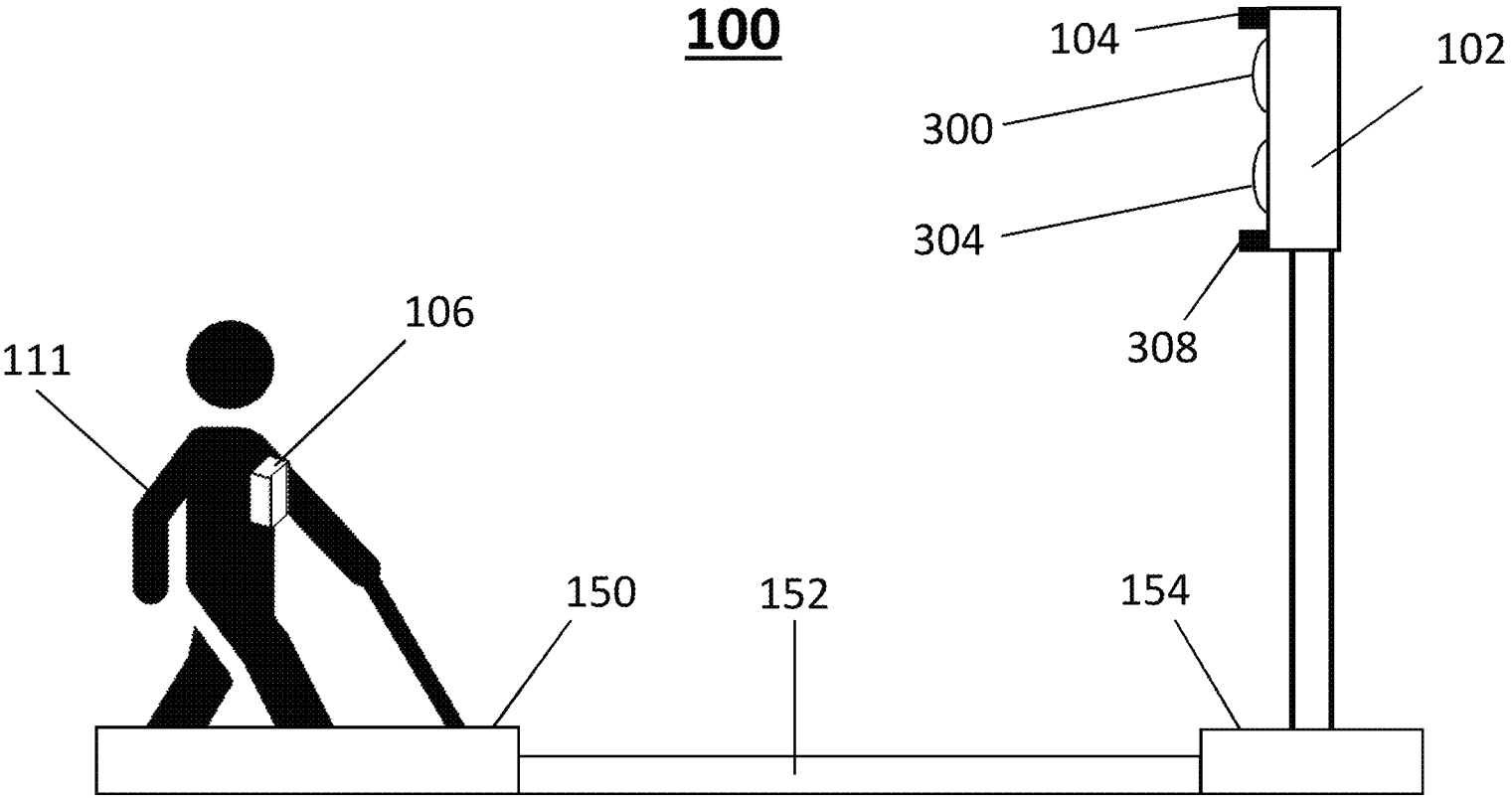
FIGS. 8*a* and 8*b* illustrate a system for conveying traffic light information to a pedestrian, according to some embodiments of the present invention.
Figure 8B:
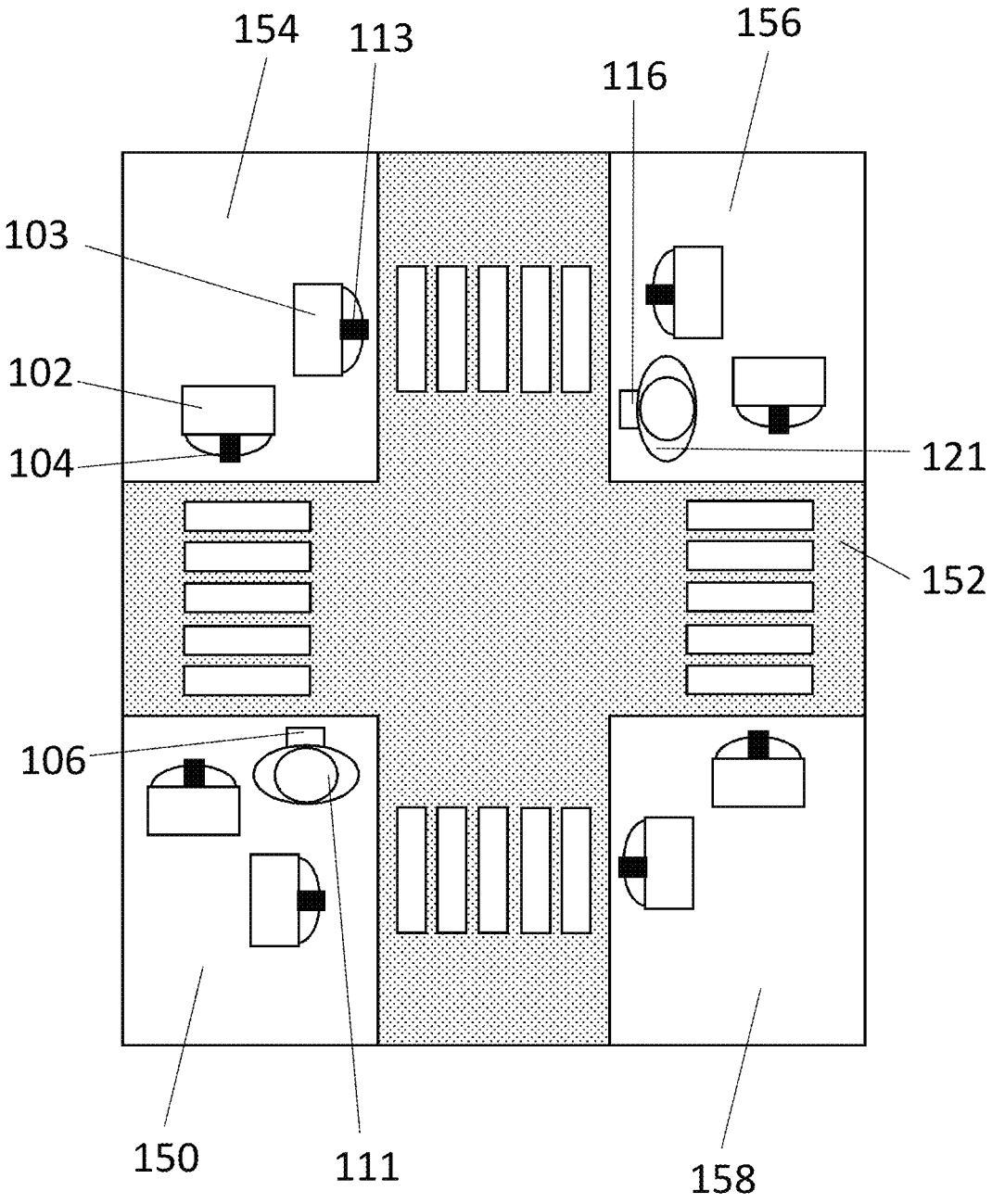

FIGS. 8*a* and 8*b* illustrate a system 100 for conveying traffic light information to a pedestrian, according to some embodiments of the present invention. FIG. 8*a* is a side view of the pedestrian at a crossroads. FIG. 8*b* is a top view of the pedestrian at a crossroads.

The system includes one or more signal transmitters (104, 308) associated with a traffic light 102 having one or more light emitting devices (300, 304), and a receiving device 106 associated with a pedestrian 111.

The pedestrian 111 is standing on a sidewalk 150 and wishes to cross a road 152 to reach a second sidewalk 154. The traffic light 102 has a green light 300 and a red light 304. In one variant, one signal transmitter 104 is provided, configured for selectively emitting an electromagnetic wave with two different encodings, a first encoding being used when the red light is active, and a second encoding being used when the green light is active (as described above in FIGS. 5 and 6). In another variant, two signal transmitters are provided, each associated with a respective light emitter and configured for emitting an electromagnetic wave with a respective encoding when the associated light emitter is active (as described above in FIGS. 4 and 7).

When the pedestrian 111 is within a predetermined distance from the signal transmitter(s) (104, 308) and faces the signal transmitter(s), the receiving device 106 receives the electromagnetic wave emitted by the signal transmitter and emits an output to inform the pedestrian 111 about the color and/or shape of the active light emitting device of the traffic lights 102. This is because the electromagnetic wave emitted by the signal transmitter(s) is a directional electromagnetic wave having power above a certain threshold within a predetermined distance from the signal transmitter and within a predetermined orientation.

In FIG. 8*b*, it can be seen that the crossroads has four separate sidewalks 150, 154, 156, and 158. Two traffic lights are disposed at each sidewalk, facing the two closest sidewalks. For example, the sidewalk 154 has two traffic lights 102 and 103. The first traffic lights 102 face the sidewalk 150, while the second traffic lights 103 face the sidewalk 156.

A first pedestrian 111 with receiving device 106 faces the first traffic lights 102. Because of the directionality of the electromagnetic wave emitted by the signal transmitter 104 of the first traffic lights and the directionality of the reception of the receiving device 106 (i.e., the receiving device only receives electromagnetic waves propagating in a range of orientations within the direction faced by the receiving device), the receiving device only receives the electromagnetic waves from the signal transmitter 104 of the first traffic lights 102.

Similarly, a second pedestrian 121 has a second receiving device 116 which faces the second traffic lights 103 having a second signal transmitter 113. Because of the directionality of the electromagnetic wave emitted by the second signal transmitter 113 of the second traffic lights and the directionality of the reception of the second receiving device 116, the second receiving device 116 only receives the electromagnetic waves from the second signal transmitter 113 of the second traffic lights 113.

The above is especially advantageous to visually impaired people. As will be described further below, the receiving device may be wearable so that the detector of the receiving unit faces the direction faced by the person wearing the receiving device.

In some embodiments of the present invention, the traffic lights include a timer (as shown, for example in FIG. 6) which counts the time remaining before the green light is deactivated and the red light is activated and vice versa. In a variant, the timer is connected to a signal transmitter configured for sending an electromagnetic wave to the receiving device encoded with information relating to the remaining time. The output unit of the receiving device is configured for emitting an output (e.g., an audio countdown), to inform the user when the lights will turn.

Figure 9:
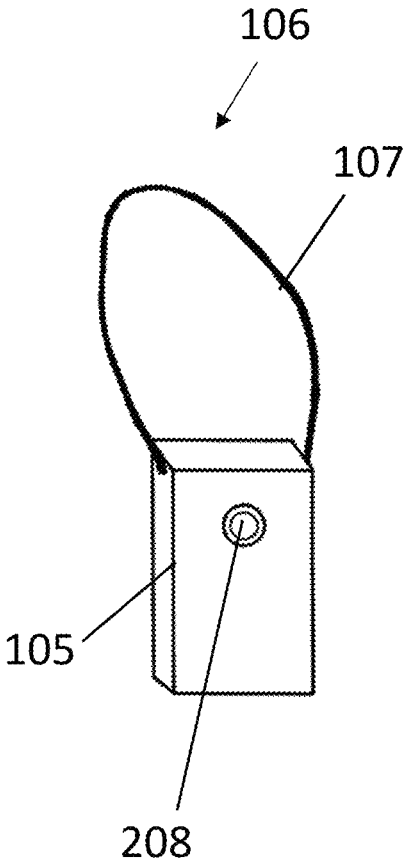
FIG. 9 illustrates an example of a receiving device configured to be carried by a pedestrian, according to some embodiments of the present invention.
Figure 10:
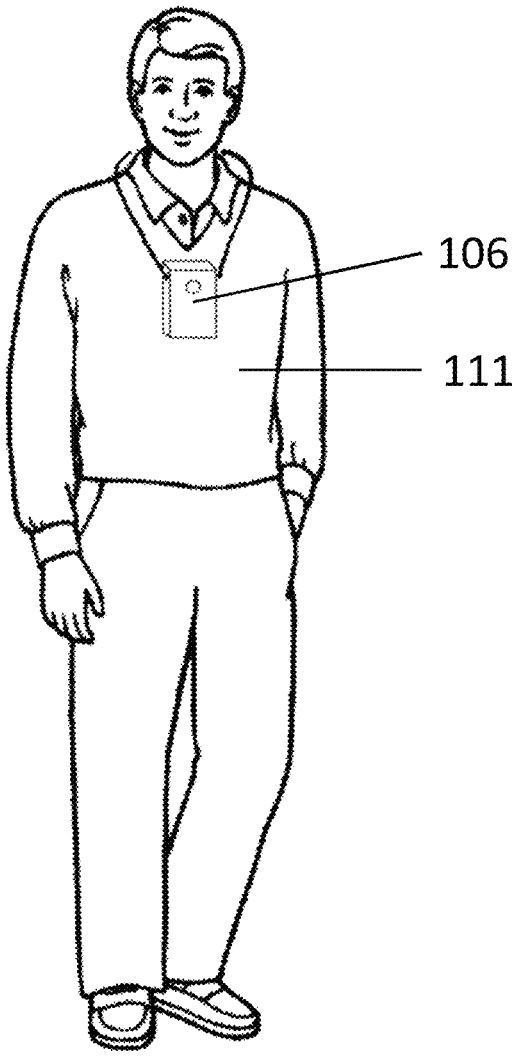
FIG. 10 illustrates a pedestrian wearing the receiving device of FIG. 9.

FIG. 9 illustrates an example of a receiving device 106 configured to be carried by a pedestrian 111, according to some embodiments of the present invention. FIG. 10 illustrates a pedestrian wearing the receiving device of FIG. 9.

Figure 11:
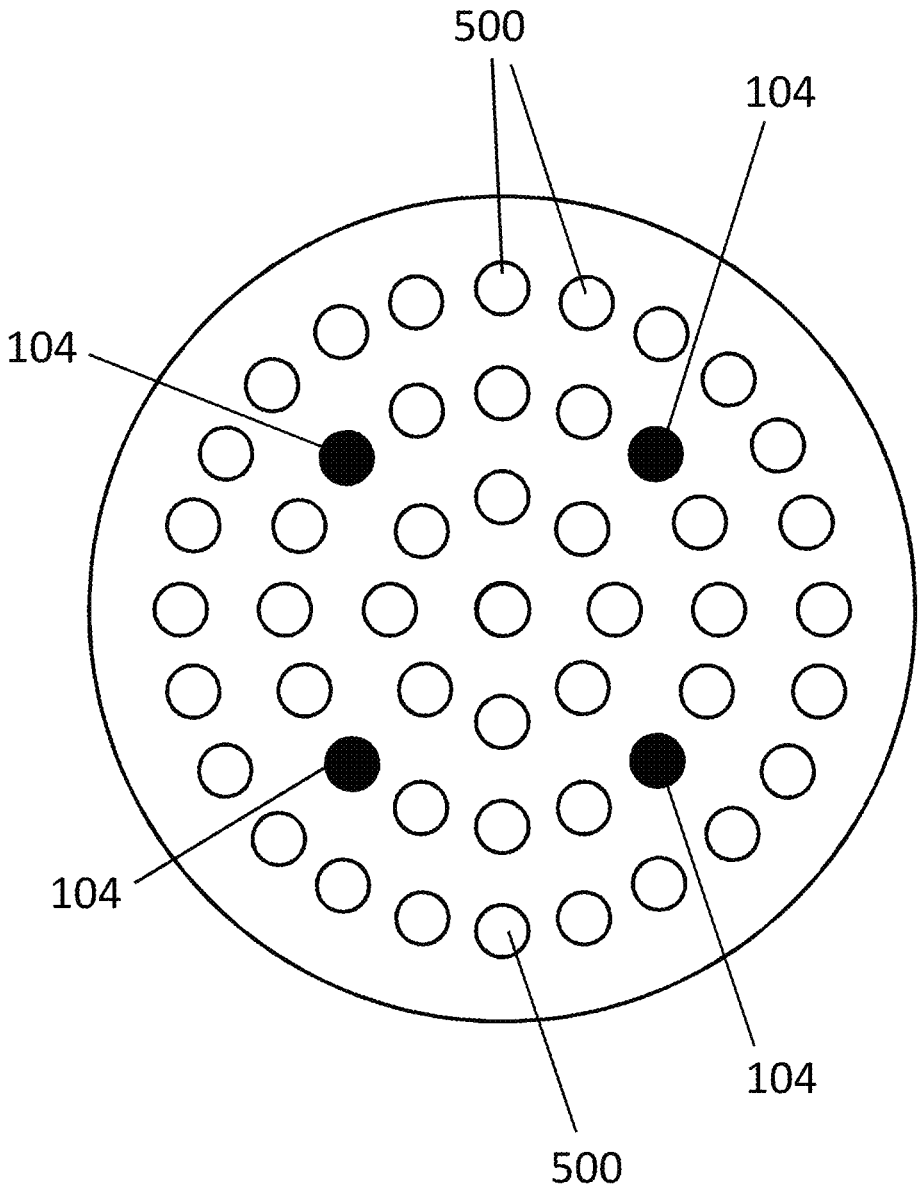
FIG. 11 is a front view of light emitting device of a traffic light of the present invention, the light emitting device having a plurality of light sources and one or more signal transmitters interspersed among the light sources.

The receiving device 106 includes a case 105 that encloses the units described in FIG. 2. The output unit 208 may include a speaker mounted on the case 105 and facing outwards, in order to be clearly heard by the pedestrian 111. Optionally, the receiving device 106 includes a string or chain 107 configured to be worn around the user's neck, so that the detector of the receiving device faces in the same direction faced by the pedestrian 111 when the receiving device is worn. FIG. 11 is a front view of a traffic light of the present invention, the light emitting device having a plurality of light sources 500 while one or more signal transmitters 104 are interspersed among the light sources.

In the embodiment of FIG. 11, the light emitting device of the traffic light includes a plurality of light sources 500 disposed as an array to create a desired shape (e.g. a circular shape, an arrow shape, etc.). Optionally, the light emitting device is covered by a diffusing cover configured for diffusing the light emitted by the light sources. In this manner, the light beyond the cover propagates uniformly and the individual light sources are not discerned from each other.

One or more signal transmitters 104 are interspersed among the light sources 500 to create the electromagnetic wave which is propagates with the light emitted by the light sources 500. In this manner, the electromagnetic wave reaches detectors that are in line of sight with the light emitting device which includes the light sources 500.

As mentioned above, the signal transmitters 104 may include LEDs emitting visible light or infrared electromagnetic waves. LEDs are highly directional and therefore well-suited to be used as signal emitters for creating a directional electromagnetic wave. The IRLEDs face the same forward direction as the light sources and therefore the electromagnetic wave emitted by the IRLED propagates in the same direction as the light emitted by the light sources.

Currently, IRLEDs emit electromagnetic waves that have less power than electromagnetic waves emitted by visible light LEDs. Using more than one IRLED (such as two, three, four, or more) which are located in the array of light sources 500 and which simultaneously emit the encoded electromagnetic signal increases the power of the combined electromagnetic wave, so that it can be detected by the receiving device at a desired distance (e.g., up to 500 feet).

The encoding may be a time-based encoding, i.e., the encoding is based on the IRLEDs (or other signal transmitters) turning on and off in a certain time pattern. If more than one signal transmitter is present for one light emitting device, the signal transmitters associated with the same light emitting device are to turn on and off simultaneously, to generate a combined directional electromagnetic wave having a predetermined encoding.

Figure 12:
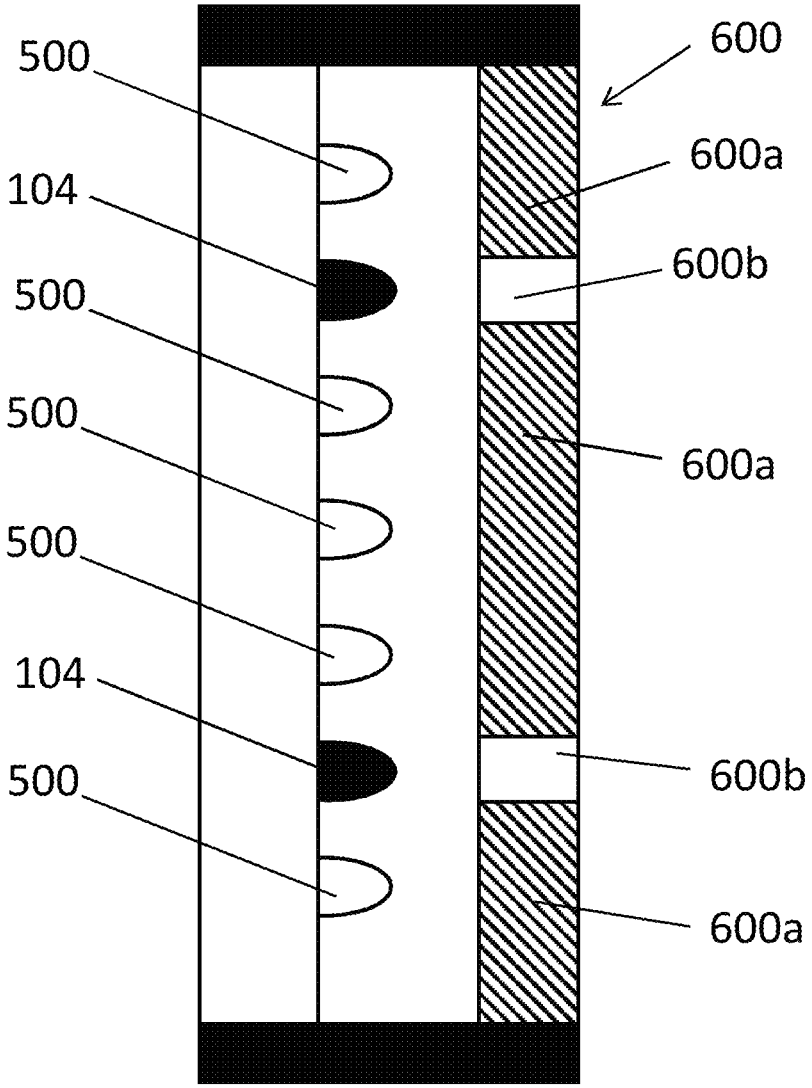
FIG. 12 is a side view of a traffic light of the present invention, in which one or more signal transmitters are interspersed among a plurality of light sources, the traffic light having a front cover with sections substantially transparent to the electromagnetic wave located in front to the signal transmitters.

FIG. 12 is cross-sectional a side view of a traffic light of the present invention, in which one or more signal transmitters 104 are interspersed among a plurality of light sources 500, the traffic light having a front cover 600 with sections substantially transparent to the electromagnetic wave located in front to the signal transmitters.

The traffic light includes a front cover 600. The front cover 600 has a diffusing section 600*a* and transparent section 600*b*. The diffusing section 600*a* is configured for diffusing the light emitted by the light sources. The transparent section 600*b* is substantially transparent to the electromagnetic wave emitted by the one or more signal transmitters 104. The transparent section 600*b* may include one or more separate portions, each located downstream of a respective signal transmitter along a main axis of propagation of the electromagnetic wave emitted by the respective signal transmitter 104.

Figure 15:
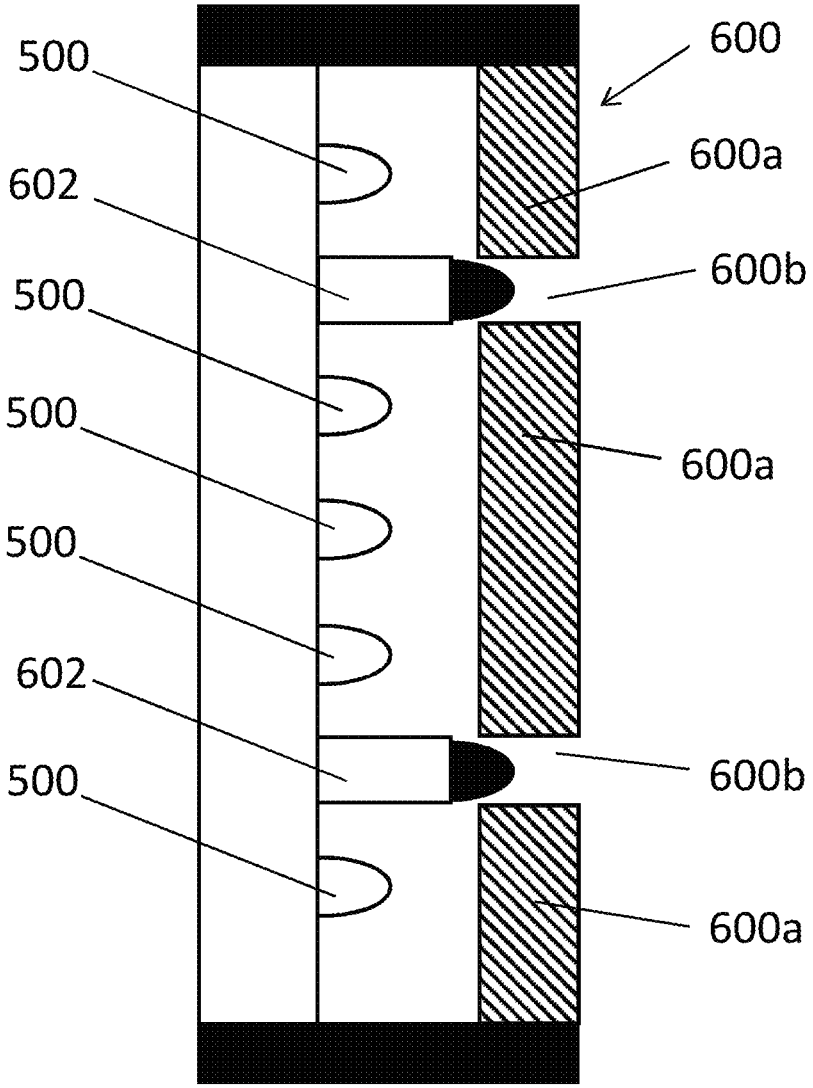
FIG. 15 is a side view of a traffic light of the present invention, in which one or more signal transmitters are interspersed among a plurality of light sources and the transparent section of the cover is the form of one or more openings on the cover.

In some embodiments of the present invention, the cover 600 is made of glass or plastic. The diffusing section 600*a* may be lensed and/or frenzeled and/or textured. In a variant, the transparent section(s) 600*b* may include one or more windows (corresponding to the one or more transmitters) which are made of smooth and flat material. In another variant, the transparent section(s) 600*b* may include one or more windows (corresponding to the one or more transmitters) in the form of apertures on the cover 600, as shown in the example of FIG. 15.

Figure 13:
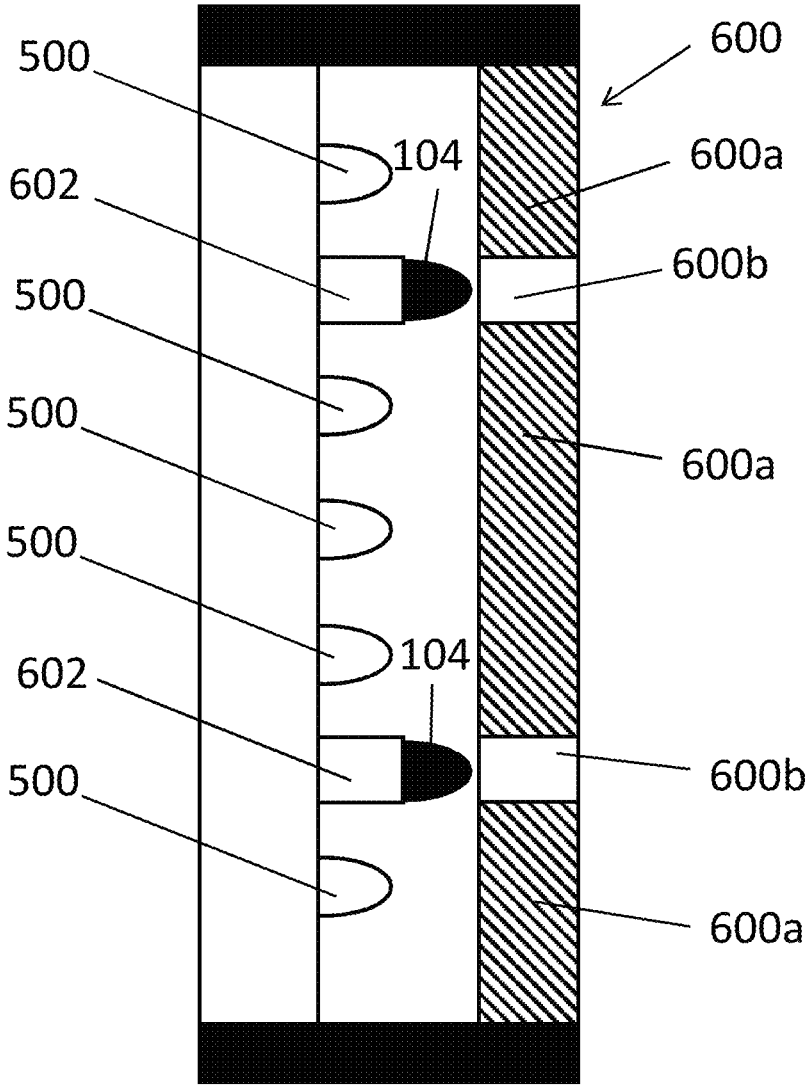
FIG. 13 is a side view of a traffic light of the present invention, in which one or more signal transmitters are interspersed among a plurality of light sources and the signal transmitters include elongated guideposts to position the signal transmitters closer to the cover.

FIG. 13 is a side view of a traffic light of the present invention, in which one or more signal transmitters 104 are interspersed among a plurality of light sources 400 and the signal transmitters 104 include elongated guideposts 602 to position the signal transmitters closer to the cover 600.

Setting the transmitter 104 closer to the cover 600 enables the transmitter to cover the transparent section 600*b*. This is especially important if the transparent section 600*b* is transparent to both the transmitter 104 and the light sources 500 (for example, if the light sources 500 are LEDs and the transmitter 104 is an IRLED), since if the transmitter does not cover the transparent section, some of the light generated by the light sources 500 will leave the cover via the transparent section and will not be diffused, creating an effect unpleasant to the eye.

Moreover, setting the transmitter 104 closer to its associated transparent section 600*b* also decreases the portion of the electromagnetic wave emitted therefrom that passes through the (or is blocked by) the diffusing section 600*a*. This is because some types transmitters (such as IRLEDs, for example) have angle of illumination, as the cross-section of the spot of the emitted electromagnetic waves grows as the distance from the emitter increases. Therefore, by increasing the portion of the emitted electromagnetic wave that passes through the transparent section increases the effectiveness and directionality of the emitted electromagnetic wave. Furthermore, the closer the transmitter 104 is to the cover 600, the smaller the size of the transparent section needs to be in order to maintain the effectiveness and directionality of the emitted electromagnetic wave. Smaller transparent sections decrease the portion of the light emitted by the light sources 500 that leaves the transparent sections, thereby decreasing unpleasant effects to the eye.

Figure 14:
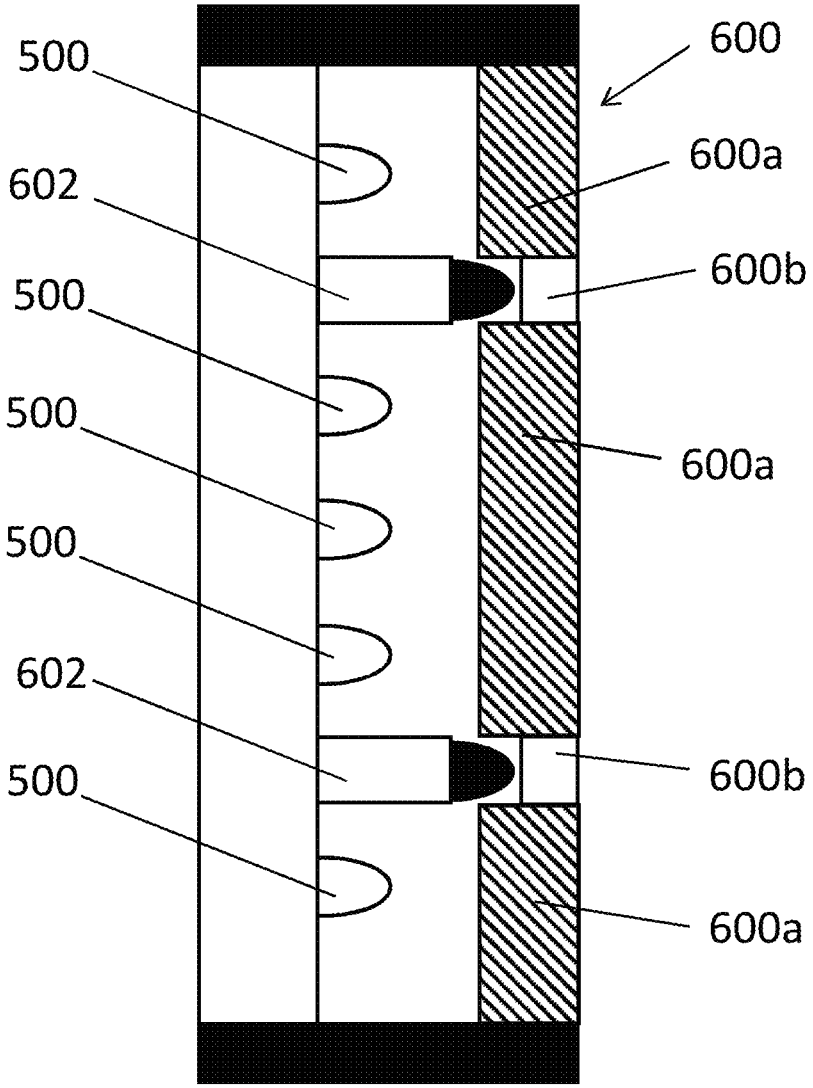
FIG. 14 is a side view of a traffic light of the present invention, in which one or more signal transmitters are interspersed among a plurality of light sources and the transparent section of the cover is thinner than the diffusing section of the cover.

FIG. 14 is a side view of a traffic light of the present invention, in which one or more signal transmitters 104 are interspersed among a plurality of light sources 600 and the transparent section 600*b* of the cover 600 includes material that is thinner than the diffusing section 600*a* of the cover. The embodiment of FIG. 14 allows the transmitter 104 to be located even closer to the cover 600 to better cover the transparent section 600*b*.

Figure 16:
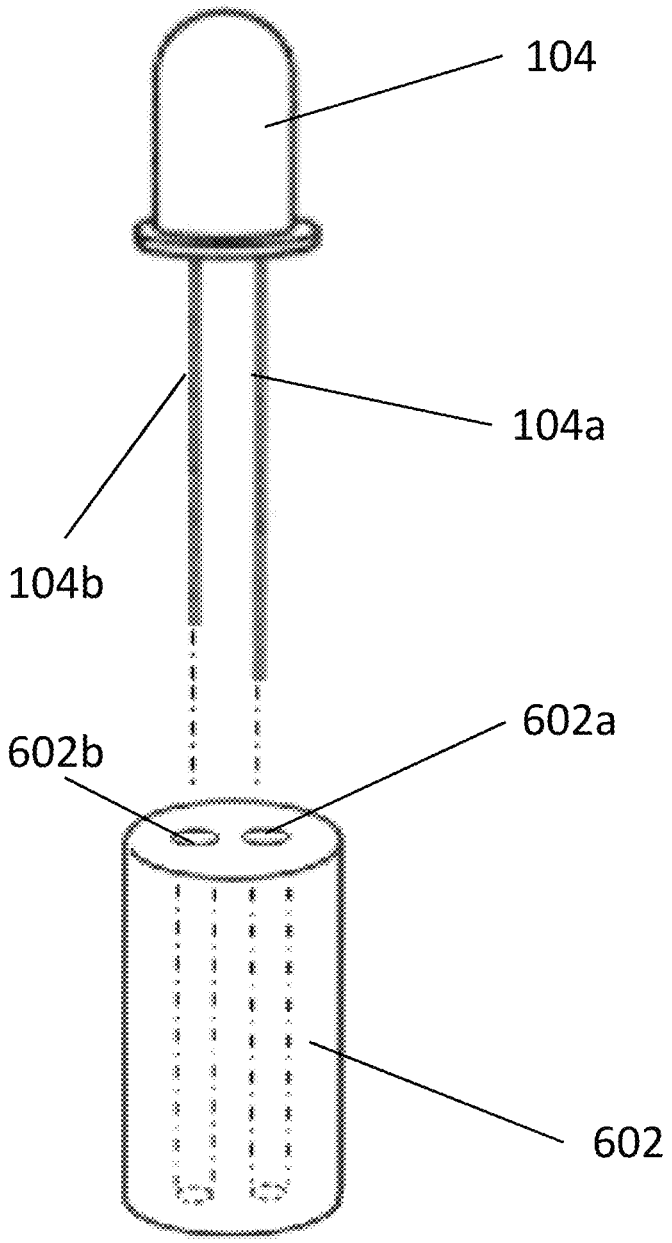
FIG. 16 is a perspective view of an elongated guidepost and the signal transmitter.

FIG. 16 is a perspective view of an elongated guidepost 602 and the signal transmitter 104. The signal transmitter 104 may include elongated electrodes 104*a* and 104*b*. The guidepost 602 is an elongated element including two channels 602*a* and 602*b* traversing the guidepost and configured for receiving and encompassing the electrodes 104*a* and 104*b*, respectively. The lower ends of the electrodes exit the channels and can be connected to a circuit board. In this manner, the guidepost provides material strength to the long, thin electrodes and allows the transmitter to be located closer to the transparent section of the cover.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. A traffic light comprising:

at least one light emitting device, configured for emitting light of a first color and/or first shape;

a signal transmitter associated with the light emitting device and configured for transmitting an encoded electromagnetic wave with encoding indicative of the first color and/or first shape of the light emitted by the light emitting device associated with the signal transmitter, the encoded electromagnetic wave being directional and having power above a predetermined threshold only within a predetermined distance from the light emitting device and within a predetermined orientation from the light emitting defined by line of sight with the light emitting device, such that the encoded electromagnetic wave is receivable by a detector only when the detector is in line of sight of and within a predetermined distance from the traffic light; and a control unit configured for activating the light emitting device together with the associated signal transmitter and deactivating the light emitting device together with the associated signal transmitter.

2. The traffic light of claim 1, comprising:

a plurality of light emitting devices, each configured for emitting light of a respective color and/or shape;

a plurality of signal transmitters, each associated with a respective one of the light emitting devices and each configured for emitting a respective electromagnetic wave with encoding indicative of the respective color and/or shape of the respective light emitting device;

wherein the control unit is configured for selectively activating each of the signal transmitters together with the respective light emitting device.

3. The traffic light of claim 1, comprising:

a plurality of light emitting devices, each configured for emitting light of a respective color and/or shape;

a plurality of signal transmitters, each associated with a respective one of the light emitting devices and each configured for emitting a respective electromagnetic wave with encoding indicative of the respective color and/or shape of respective light emitting device;

a plurality of control units, each associated with a respective one of the light emitting devices and each configured for selectively activating the signal transmitter associated with the respective light emitting device together with the respective light emitting device.

4. The traffic light of claim 1, comprising:

a plurality of light emitting devices, each configured for emitting light of a respective color and/or shape;

wherein the signal transmitter is configured for transmitting a plurality of electromagnetic waves, each electromagnetic wave having a respective encoding indicative of a respective color and/or shape emitted by a respective light emitting device; and wherein the control unit is configured for selectively activating each of the light emitting devices and for controlling an operation of the signal transmitter, such that the electromagnetic wave transmitted by the transmitter has the encoding indicative of the color and/or shape of the active light emitting device.

5. The traffic light of claim 1, wherein the light emitting device comprises a plurality of light sources arranged in an array.

6. The traffic light of claim 5, wherein the light sources comprise light emitting diodes (LEDs).

7. The traffic light of claim 5, wherein the signal transmitter is located within the array of the light sources.

8. The traffic light of claim 7, comprising one or more signal transmitters located within the array and configured for simultaneously transmitting the encoded electromagnetic wave.

9. The traffic light of claim 7, comprising a cover comprising:

a diffusing section located downstream of the light sources and configured to diffuse the light emitted by the light sources;

a transparent section substantially transparent to the electromagnetic wave, the transparent section being located downstream of the signal transmitter and configured to enable decreased diffraction of the encoded electromagnetic signal.

10. The traffic light of claim 9, wherein the transmitter comprises an elongated guidepost, configured to position the transmitter closer to the cover with respect to the light sources.

11. The traffic light of claim 9, wherein the transparent section comprises material that is thinner than diffusing section.

12. The traffic light of claim 9, wherein the transparent section comprises an opening on the cover.

13. The traffic light of claim 1, wherein the signal transmitter comprises at least one of an infra-red (IR) light source, a visible light source, a laser light source, and a radio wave source.

14. The traffic light of claim 13, wherein:

the IR light source comprises an IR light emitting diode (IRLED);

the visible light source comprises a light emitting diode (LED).

15. A traffic sign, comprising:

a visual sign having an image, the image representing a desired traffic instruction;

a signal transmitter associated with the visual sign and configured for transmitting an encoded electromagnetic wave with encoding indicative of the traffic instruction, the encoded electromagnetic wave being directional and having power above a predetermined threshold only within a predetermined distance from the signal transmitter and within a predetermined orientation from the visual sign defined by line of sight with the visual sign, such that the encoded electromagnetic wave is receivable by a detector only when the detector is in line of sight of and within a predetermined distance from the visual sign.

16. A system for increasing awareness of a traffic sign having a visual sign having an image, the image representing a desired traffic instruction, the system comprising:

a signal transmitter associated with the visual sign and configured for transmitting an encoded electromagnetic wave with encoding indicative of the traffic instruction, the encoded electromagnetic wave being directional and having power above a predetermined threshold only within a predetermined distance from the signal transmitter and within an orientation from the visual sign defined by line of sight with the visual sign;

and at least one receiving device associated with a user or a vehicle of the user, the receiving device comprising:

a detector, configured to detect the electromagnetic wave when the power of the electromagnetic wave is above the predetermined threshold, which occurs only when the detector is in line of sight of and within the predetermined distance from the visual sign;

a decoder, configured to decode the electromagnetic wave detected by the detector to extract information indicative of the traffic instruction; and an output unit, configured to emit an output indicative of the traffic instruction.

17. The system of claim 16, wherein:

the visual sign comprises at least one light emitting device, configured for emitting light of a desired color and/or in a desired shape to represent the desired instruction; and the system comprises a control unit associated with the visual sign, the control unit being configured to activate the light emitting device together with the associated signal transmitter, according to a desired timing.

18. The system of claim 16, wherein the output unit is configured to emit one or more of an electronic signal, a visible output, an audio output, and a haptic output.

19. The system of signal 16, wherein:

the user is a pedestrian;

the receiving device is configured to be worn by the user, such that the detector faces a direction faced by the pedestrian wearing the receiving device;

the detector is configured for detecting the electromagnetic wave only when a propagation axis of the electromagnetic wave is within a range of orientations around a orientation faced by the detector.

20. A receiving device associated with a user or a vehicle of the user, the receiving device comprising:

a detector, configured to detect an electromagnetic wave emitted by a signal transmitter associated with a traffic sign, the electromagnetic wave having encoding indicative of a traffic instruction represented by the traffic sign and being directional such that the electromagnetic wave has power above a predetermined threshold only within a predetermined distance from the traffic sign and within a predetermined orientation from the traffic sign defined by line of sight with the traffic sign, the detector being configured to detect the electromagnetic wave only the power of the electromagnetic wave is above the predetermined threshold, which occurs when the receiving device is in line of sight of and within a predetermined distance from the traffic sign;

a decoder, configured to decode the electromagnetic wave detected by the detector to extract information indicative of the traffic instruction; and an output unit, configured to emit an output indicative of the traffic instruction.

* * * * *